US011135134B2

(12) United States Patent
Zoczek et al.

(10) Patent No.: US 11,135,134 B2
(45) Date of Patent: Oct. 5, 2021

(54) DEVICE FOR DOSING OR COUNTING OBJECTS

(71) Applicant: STIPLASTICS, Saint Marcellin (FR)

(72) Inventors: Guillaume Zoczek, Tullins (FR); Ludovic Soual, Romans Sur Isere (FR); Hugues Brouard, Rochefort Samson (FR)

(73) Assignee: STIPLASTICS, Saint Marcellin (FR)

( * ) Notice: Subject to any disclaimer, the term of this patent is extended or adjusted under 35 U.S.C. 154(b) by 0 days.

(21) Appl. No.: 16/966,352

(22) PCT Filed: Jan. 29, 2019

(86) PCT No.: PCT/FR2019/050181
§ 371 (c)(1),
(2) Date: Jul. 30, 2020

(87) PCT Pub. No.: WO2019/150027
PCT Pub. Date: Aug. 8, 2019

(65) Prior Publication Data

US 2020/0368112 A1 Nov. 26, 2020

(30) Foreign Application Priority Data

Jan. 31, 2018 (FR) ..... 1850772
Mar. 7, 2018 (FR) ..... 1851986

(51) Int. Cl.
*A61J 7/02* (2006.01)
*A61J 1/03* (2006.01)
*G06M 1/08* (2006.01)

(52) U.S. Cl.
CPC . *A61J 7/02* (2013.01); *A61J 1/03* (2013.01); *G06M 1/083* (2013.01)

(58) Field of Classification Search
CPC ..... A61J 7/02; A61J 1/03; G06M 1/083
See application file for complete search history.

(56) References Cited

U.S. PATENT DOCUMENTS 2,623,647 A * 12/1952 Erickson ..... G06M 11/00 414/675
2,863,572 A * 12/1958 Bethard ..... A61J 7/02 414/675

(Continued)

FOREIGN PATENT DOCUMENTS

GB 1193994 A 6/1970
GB 1263927 A 2/1972

OTHER PUBLICATIONS

International Search Report, corresponding International Application No. PCT/FR2019/050181, dated May 23, 2019.

(Continued)

*Primary Examiner* — Michael Collins
(74) *Attorney, Agent, or Firm* — Marshall, Gerstein & Borun LLP

(57) ABSTRACT

A device for dosing or counting objects includes: a plate with a plurality of recesses, each suitable for receiving a single object and arranged in at least two series of at least two rows in parallel along a longitudinal axis, such that the recesses in a first row of one series are offset longitudinally relative to the recesses in the second row of the same series by a non-zero pitch; and a pull element arranged to slide relative to the plate along the longitudinal axis and comprising at least two adjacent tongues, each designed to cover or reveal a corresponding series of rows and arranged to slide relative to one another over a distance equal to the pitch and coupled by a drive mechanism such that the sliding of the pull element along the longitudinal axis over a distance greater than the pitch causes the simultaneous movement of two tongues.

18 Claims, 10 Drawing Sheets

(56) References Cited

U.S. PATENT DOCUMENTS

| | | | | |
|---|---|---|---|---|
| 4,047,620 | A | 9/1977 | Deininger | |
| 6,021,901 | A * | 2/2000 | Wolfe | B65D 43/162 206/1.5 |
| 6,789,677 | B2 * | 9/2004 | Maietta | B65D 43/18 206/1.5 |
| 7,617,935 | B2 * | 11/2009 | Reilley | B65D 83/0463 206/530 |
| 8,066,122 | B2 * | 11/2011 | Beecroft | B65D 83/0463 206/536 |
| 8,181,772 | B2 * | 5/2012 | Short | B65D 83/0463 206/1.5 |
| 8,220,636 | B2 * | 7/2012 | Beecroft | B65D 83/0472 206/535 |
| 2004/0178111 | A1 * | 9/2004 | Harrold | G07F 17/0092 206/532 |
| 2004/0191313 | A1 | 9/2004 | Moest et al. | |
| 2005/0183981 | A1 * | 8/2005 | Gelardi | B65D 83/0463 206/531 |
| 2007/0262273 | A1 | 11/2007 | Sun et al. | |

OTHER PUBLICATIONS

Written Opinion of the International Searching Authority, corresponding to International Application No. PCT/FR2019/050181, dated May 23, 2019.

* cited by examiner

DEVICE FOR DOSING OR COUNTING OBJECTS

CROSS-REFERENCE TO RELATED APPLICATIONS

This application is a U.S. National stage of International Patent Application No. PCT/FR2019/050181 filed Jan. 29, 2019, which claims the benefit of priority of French Patent Application No. 1850772 filed Jan. 31, 2018, and French Patent Application No. 1851986 filed Mar. 7, 2018, the respective disclosures of which are each incorporated herein by reference in their entireties.

BACKGROUND

Field of the Invention

The present invention relates to a device for dosing or counting objects, such as granules for example.

Prior Art

When objects are contained in a recipient, there is the problem of taking from within the recipient a precise number of objects. Such is the case for example for granules or tablets contained in a recipient that comprises several doses of a drug treatment, the patient for whom this treatment is intended having to take from this recipient the dose that corresponds to the dosage plan that was prescribed for this patient.

However, when the objects are of a small size and each dose is constituted of a significant number of objects, the taking of the adequate number of objects is long and tedious.

It is therefore desirable to have a dosing device that makes it possible to simply take the required number of objects.

Document US 2004/0191313 describes such a dosing device. Said device comprises a handle and an endpiece wherein are arranged individual recesses intended to each receive one object, along a plurality of parallel rows. The number of individual recesses that the device has is thus from about 5 to 100. In order to facilitate the taking of the desired number of objects, the device comprises a covering system that can slide in a direction perpendicular to the rows, including telescopic sections. Such a system thus makes it possible to cover a defined number of rows of individual recesses. However, since each row can be either uncovered or covered entirely, the device makes it possible to take only a number of objects that is a multiple of the number of recesses of each row. Consequently, if the user wishes a different number of objects, he must put back into the recipient the excess object or objects. This therefore implies that the user counts the objects, and this also poses hygiene problems when objects extracted from the recipient have to be put back therein.

SUMMARY

A purpose of the invention is therefore to design a device for dosing or counting objects contained in a recipient, which, while still having a reduced size and by being simple to use, makes it possible to take from within said recipient the exact number of objects desired, so as to allow the user to know immediately the quantity taken, and to avoid having to put back into the recipient supernumerary objects.

For this purpose, the invention proposes a device for dosing or counting objects, comprising:

- a plate provided with a plurality of recesses each suitable for receiving a single object, said recesses being arranged in at least two series of at least two rows disposed in parallel along a longitudinal axis such that the recesses in a first row of one series are offset longitudinally relative to the recesses in the second row by a non-zero pitch;
- a pull element arranged to slide relative to the plate along said longitudinal axis, said pull element comprising at least two adjacent tongues, each designed to cover or uncover a corresponding series of rows, said tongues being arranged to slide relative to one another over a distance equal to said pitch and coupled by a drive mechanism configured such that the sliding of the pull element along the longitudinal axis over a distance greater than said pitch causes the simultaneous movement of the two tongues.

"Size of the recesses" means in the present text the dimension of said recesses along the longitudinal axis. In the case where the recesses have a circular contour, said size is the diameter of the circle. Likewise, the length of an element extends along the longitudinal axis.

Thus, thanks to the arrangement of the recesses along several parallel rows, the device is much shorter than a device that has a single row of recesses that can be selectively covered or uncovered by a single pull element.

Moreover, the device is particularly simple to use since the actuating of the pull element by the user automatically moves a tongue or both in order to define the desired dose.

According to a particularly advantageous embodiment, the drive mechanism comprises a longitudinal notch formed in at least one of the tongues and an abutment extending in the notch from another tongue, the difference between the length of the notch and the length of the abutment being substantially equal to said pitch.

According to an embodiment preferred for its production simplicity and its intuitive use, the recesses are arranged in the form of two pairs of two parallel rows and the pull element comprises two tongues facing each pair of rows.

The drive mechanism is advantageously configured to procure the following positions of the pull element with respect to the plate:

- a closed position in which each one of the tongues covers all of the recesses of the corresponding pair of rows;
- a plurality of first open positions in which the tongues uncover an odd total number of recesses, the ends of said tongues being offset longitudinally over a distance equal to the pitch;
- a plurality of second open positions in which the tongues uncover an even total number of recesses, the ends of said tongues being longitudinally aligned;

the passing from the closed position to a first open position comprising a longitudinal movement of a first tongue in a direction of opening over a distance equal to the pitch, the other tongue remaining immobile, then, if the number objects is greater than one, a simultaneous longitudinal movement of the two tongues in the direction of opening;

the passing from a first open position to a second open position comprising a longitudinal movement of the first tongue over a distance equal to said pitch in a direction of closing then, if the difference between the number of objects is greater than one, a simultaneous longitudinal movement of the two tongues in the direction of closing.

According to an embodiment, the plate includes two lines of graduations, each graduation indicating a unique number of objects, and the pull element comprises two windows arranged facing a corresponding line of graduations in such a way that the total number of recesses uncovered by the pull element appears through one of the two windows.

Preferably, the graduations of one of said lines indicate the even numbers of objects and the graduations of the other line indicate the odd numbers of objects.

According to an embodiment, each tongue comprises a corresponding first window arranged facing the line of graduations indicating the odd numbers of objects, and a corresponding second window arranged facing the line of graduations indicating the even numbers of objects, the first and the second window of one tongue being longitudinally aligned while the first and the second window of the other tongue are offset longitudinally over a distance equal to said pitch.

Advantageously, an odd number of one line is substantially aligned longitudinally with the next immediately higher even number of the other line.

According to another embodiment of the device, the recesses are arranged in the form of three series of three parallel rows and the pull element comprises three tongues.

Particularly advantageously, each tongue cooperates with the plate by a notched slider, the distance between two adjacent notches being equal to said pitch. Moreover, the plate has a tooth extending transversally and being engaged in a notch of a corresponding slider.

The device may further comprise a cover rigidly connected to the plate, the pull element being arranged between the plate and the cover.

According to an embodiment, the plate comprises between ten and thirty recesses.

Advantageously, each recess has a circular contour.

Preferably, the pitch is less than the size of said recesses.

According to an embodiment, the plate has a domed concave end forming a spoon.

According to an embodiment, the device further comprises a cap extending around the plate to form with the plate a volume for receiving objects, said cap comprising an endpiece suitable for being attached to a recipient containing the objects to be counted or dosed.

Particularly advantageously, the cap comprises a transparent portion facing the plate in order to allow a user to check if an object is present in each recess uncovered.

"Transparent" means that a user can discern through the cap if each recess uncovered has indeed been filled by an object.

DESCRIPTION OF THE FIGURES

Other characteristics and advantages of the invention shall appear in the following detailed description, in reference to the accompanying drawings wherein.

DETAILED DESCRIPTION OF EMBODIMENTS OF THE INVENTION

Figure 1:
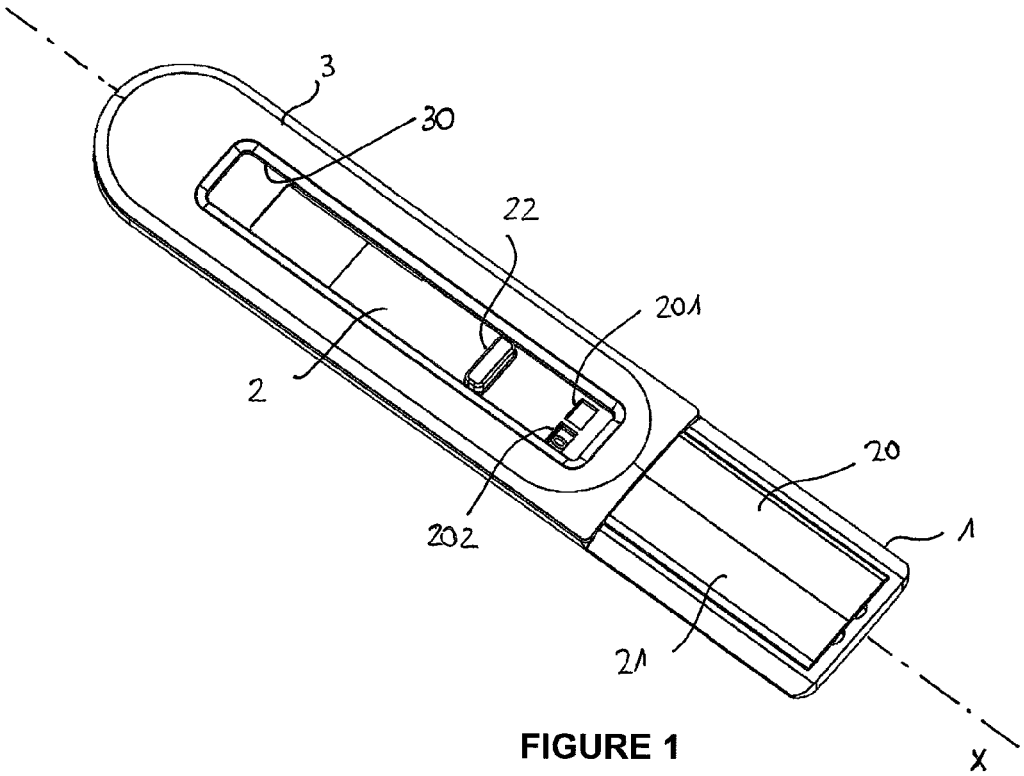
FIG. 1 is a perspective view of the device according to an embodiment of the invention, in the closed configuration.

The invention proposes a device for dosing or counting objects comprising two main portions.

The first main portion is a plate wherein are arranged a plurality of recesses, the number of recesses being equal to the maximum number of objects to be dosed or counted by said device. For example, the number of recesses may be comprised between ten and thirty.

Each recess is dimensioned to receive a single object. The shape of the recess may therefore be adapted according to the shape of the objects to be dosed or counted. Particularly advantageously, each recess has a circular contour.

The recesses are arranged according to rows arranged parallel to one another along a longitudinal axis of the device (noted as X in the figures) which, as shall be seen hereinbelow, is the axis of opening and of closing of the device.

Preferably, and as shown in FIGS. 1 to 9 which shall be described in detail hereinbelow, the recesses are arranged in the form of two pairs each constituted of two adjacent rows. It is however possible to provide a different arrangement of the recesses, for example in the form of three series each formed of three parallel rows, without however leaving the scope of the present invention. This particular embodiment shall be described in reference to FIGS. 10 to 18.

Within the same pair, the recesses are arranged in staggered fashion, i.e. the recesses of a first row of the pair are offset longitudinally (along the axis X) with respect to the recesses of the second row of the pair, over a determined pitch (noted as P in the figures). The pitch is defined as the distance, along the axis X, between the centre of a recess of one row and the centre of an immediately adjacent recess of the other row of the same pair. Advantageously, in order to preserve the compactness of the device, the pitch is lower than the size of the recesses, while still being non-zero.

The recesses of a row of the first pair are advantageously aligned (along the axis X) with the recesses of the adjacent row of the second pair.

The second main portion is a pull element comprising two adjacent tongues, each one suited to cover a pair of rows of recesses of the plate.

Said pull element is arranged to slide relative to the plate along the axis X, in such a way that a movement of a tongue along the axis X makes it possible to uncover or to cover one or several recesses of the corresponding pair of rows.

As shall be explained in detail hereinbelow, the two tongues are able to slide with respect to one another along the axis X, and are moreover coupled by a drive mechanism configured such that the sliding of the pull element along the axis X over a distance greater than the pitch P causes the simultaneous movement of the two tongues.

The pull element advantageously has a means for facilitating the manipulation thereof by a user, for example a lug in relief that can be actuated by a finger of the user.

Advantageously, the device further comprises a cover that is rigidly attached to the plate, which makes it possible to maintain the pull element by sliding with regards to the plate. The cover may be fixed to the plate by any suitable means (welding, gluing, screwing, snap-fitting, etc.).

The cover has a longitudinal opening that gives access to the pull element for the actuating thereof by a user.

Figure 2:
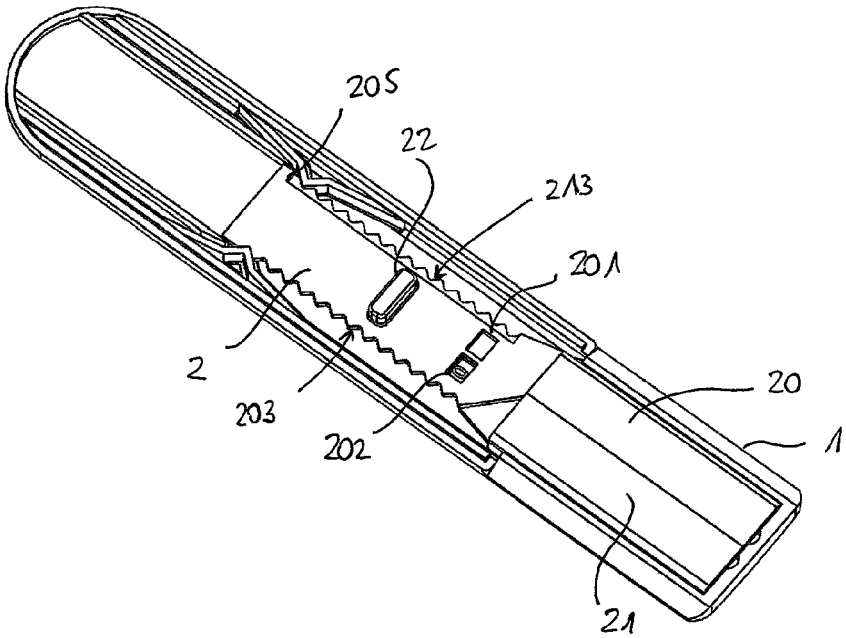
FIG. 2 is a perspective view of the device of FIG. 1, the cover being removed.
Figure 3:
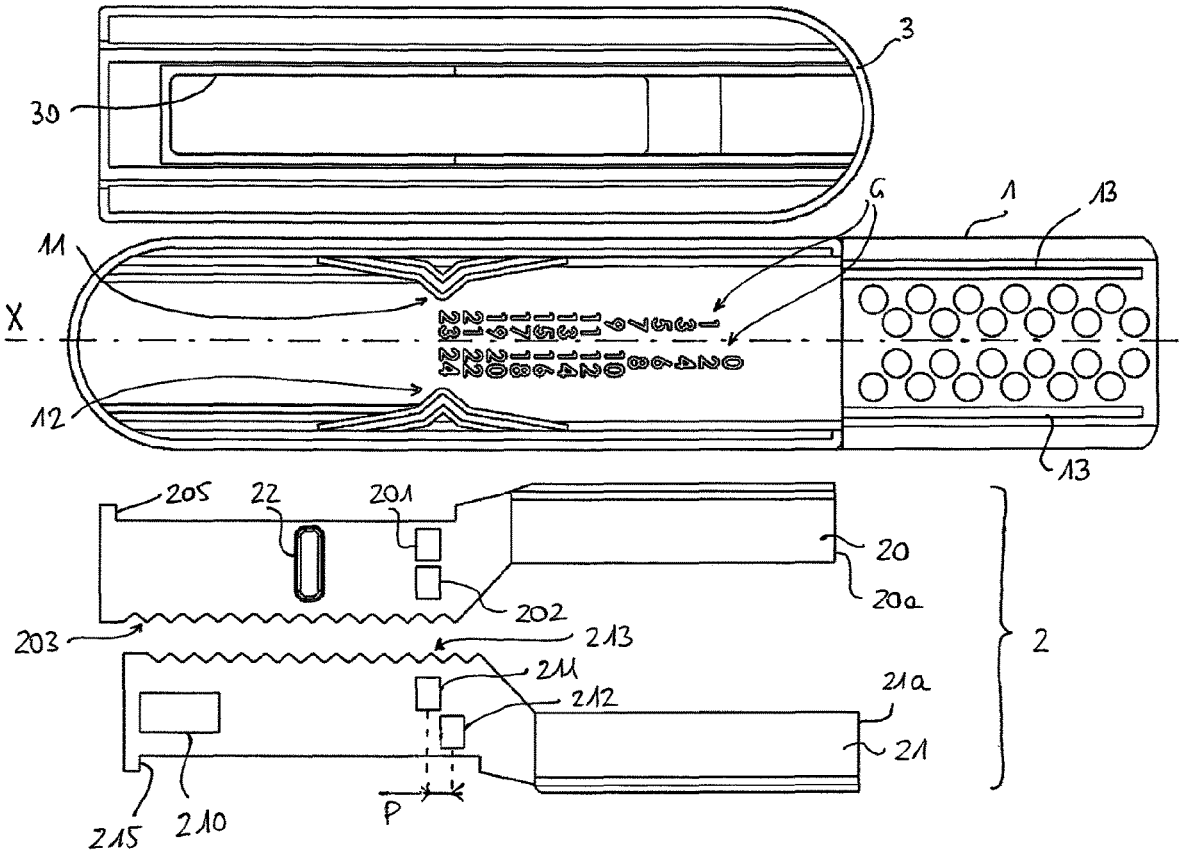
FIG. 3 is an exploded top view of said device.

FIGS. 1 and 2 show an embodiment of the device, respectively with and without the cover in order to make it possible to better view the arrangement of the different parts. In these two figures, the device is shown in the closed position, i.e. all the recesses are covered by the two tongues, therefore not being able to receive any object. FIG. 3 is an exploded top view of the different parts that the device is comprised of.

Figure 8:
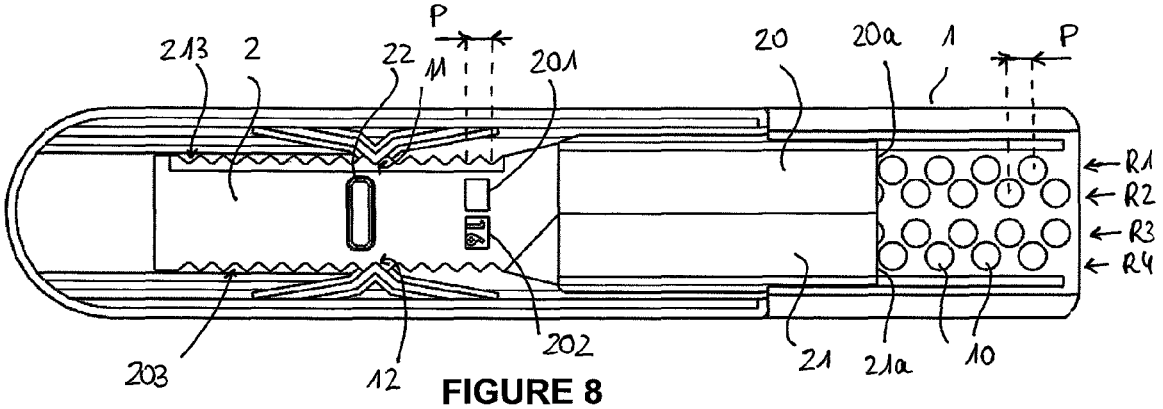
FIG. 8 is a perspective view of said device, in a configuration of use that makes it possible to dose sixteen objects.
Figure 9:
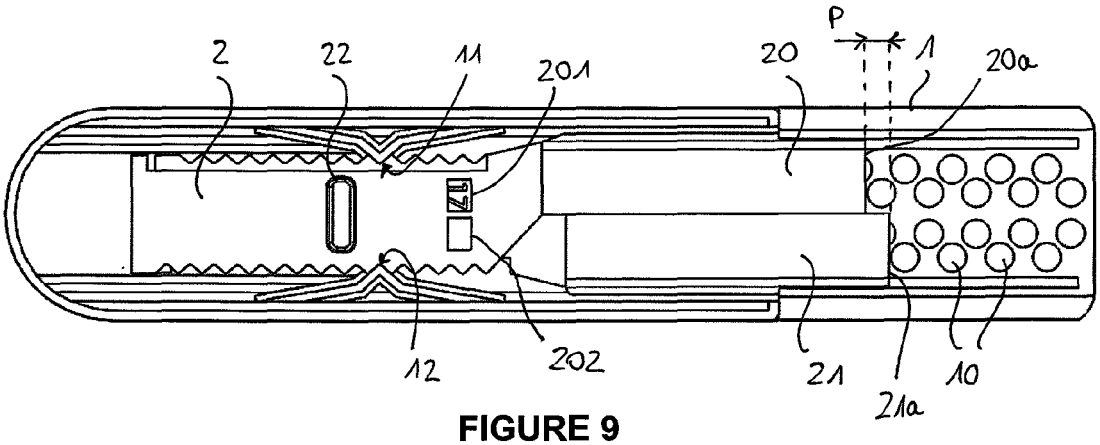
FIG. 9 is a perspective view of said device, in a configuration of use that makes it possible to dose seventeen objects.

The plate 1 has a general rectangular and substantially flat shape. The plate comprises three main zones, namely (from right to left in FIG. 3):

- a first end zone comprising four rows R1-R4 of recesses 10 (the rows R1-R2 forming a first pair and the rows R3-R4 forming a second pair, as also shown in FIG. 8). The length of this first end zone is long enough for the arrangement of all the recesses required to allow for the dosing of the maximum desired number of objects. In the width-wise direction, extend on either side of the two pairs of rows two longitudinal grooves 13 wherein slide a longitudinal rib of the tongues (the rib 204 of the tongue 20 can be seen in FIG. 4; the tongue 21 has a similar rib);
- a central zone comprising two lines of graduations G extending along the axis X, each graduation indicating a unique number of objects between 0 (or 1) and the maximum number of objects to be dosed (24 in the embodiment shown). The graduations of one of said lines indicate the even numbers of objects and the graduations of the other line indicate the odd numbers of objects. This central zone further comprises two teeth 11, 12 which extend transversally to the axis X and which, as shall be seen hereinbelow, cooperate with the pull element to form an indexing mechanism;
- a second end zone, opposite the first, substantially provided to allow the sliding of the pull element to the extreme open position thereof.

The pull element 2 is formed of a first tongue 20 and from a second tongue 21, able to slide with respect to one another along the axis X. The pull element is moreover arranged slidingly along the axis X with respect to the plate 1.

Each tongue comprises two main zones, namely (from right to left in FIG. 3):

- a first zone, called the closure zone, of which the length and the width are chosen to fully receive a corresponding row (R1-R2 or R3-R4) when the pull element is in the extreme closed position such as shown in FIGS. 1 and 2;
- a second zone, called the actuating zone, comprising a mechanism from mutually driving the tongues.

The pull element is assembled by superimposing the actuating zone of the tongue 20 on the actuating zone of the tongue 21 (the actuating zone of the tongue 21 being arranged between the plate 1 and the actuating zone of the tongue 20). Note that, for each tongue, the closure zone is offset in a direction transversal to the axis X with respect to the actuating zone. Moreover, the closure zone may be offset with respect to the actuating zone in the direction of the thickness of said tongues. The value of these offsets is chosen so that, when the pull element 2 is assembled, the closure zones of the two tongues 20, 21 extend side by side along the length thereof, in the same plane parallel to the plane of the plate 1.

The pull element has an actuating lug 22 that allows a user to slide it in a direction of opening or closing using one of their fingers. Preferably, this lug 22 extends directly from the upper tongue 20.

Figure 4:
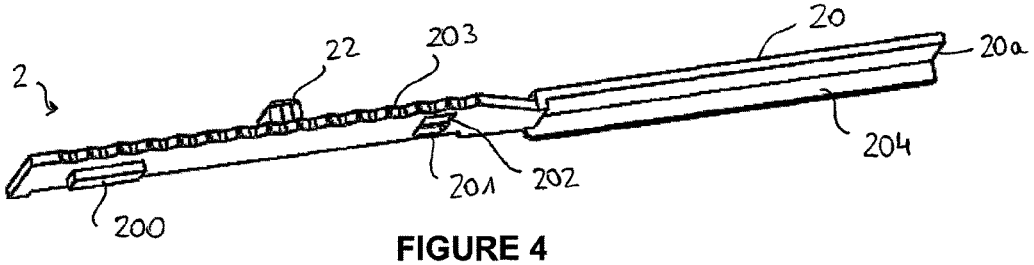
FIG. 4 is a perspective view of a portion of the pull element comprising a driving abutment.

According to a preferred embodiment, the drive mechanism of the tongues 20, 21 with respect to one other comprises a longitudinal notch 210 (formed for example in the lower tongue 21) and a longitudinal abutment 200 (extending for example from the lower face of the upper tongue 20, as shown in FIG. 4), having a length less than that of the notch 210 and arranged in said notch 210 when the pull element is assembled.

The difference between the length of the notch 210 and the length of the abutment 200 is substantially equal to the pitch P. Consequently, the maximum sliding travel of a tongue with respect to the other in a given direction is substantially equal to the pitch P. Beyond this travel, the abutment is in contact with the edge of the notch and a sliding of a tongue in this same direction drives the simultaneous sliding of the other tongue.

Moreover, the existence of this relative sliding clearance of the two tongues makes for, according to the configuration of the pull element, that the ends 20*a*, 21*a* of the two tongues may be either aligned (i.e. in the same longitudinal position), or offset over a distance substantially equal to the pitch P along the axis X. As shall be seen hereinbelow, these relative positions are made use of according to whether the desired number of objects to be dosed or counted is even or odd.

Figure 5A:
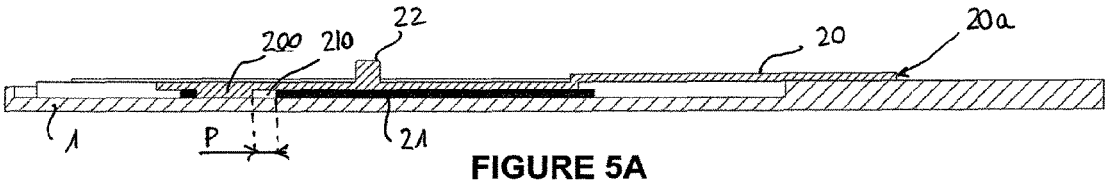
FIGS. 5A and 5B are cross-section views of the device in a configuration that respectively makes it possible to dose an odd number and an even number of objects.
Figure 5B:
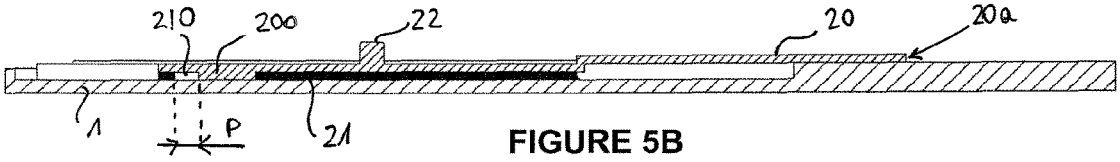

FIGS. 5A and 5B are cross-section views of the device in a configuration that respectively makes it possible to dose an odd number and an even number of objects. In these figures, the recesses are arranged in the right portion of the plate 1. The direction of opening is therefore oriented from right to left, and the direction of closing from left to right. As can be seen in FIG. 5A, when the device is in the open configuration that makes it possible to uncover an odd number of recesses, the abutment 200 is in contact with the left end of the notch 210. Consequently, from this configuration, a movement of the lug 22 in the direction of opening will immediately drive a simultaneous sliding of the two tongues, while a movement in the direction of closing will first drive a sliding of the tongue 21 alone, over a distance equal to the pitch P, then, once the abutment 200 bears against the right end of the notch 210, a simultaneous sliding of the two tongues. Inversely, as can be seen in FIG. 5B, when the device is in the open configuration making it possible to uncover an even number of recesses, the abutment 200 is in contact with the right end of the notch 210. Consequently, from this configuration, a movement of the lug 22 in the direction of opening will first drive a sliding of the tongue 20 alone, over a distance equal to the pitch P, then, once the abutment 200 is bearing against the left edge of the notch 210, a simultaneous sliding of the two tongues, while a movement of the lug in the direction of closing will immediately drive a simultaneous sliding of the two tongues.

Particularly advantageously, the pull element comprises two windows arranged facing a corresponding line of graduations G on the plate, in such a way that the total number of recesses uncovered by the pull element appears through one of the two windows. Since the actuating zones of the tongues 20, 21 are superimposed, each tongue comprises in fact two windows of which one is facing a window of the other tongue, and the other is closed by a solid surface of the other tongue.

More precisely, according to an embodiment, the windows 201, 202 of the upper tongue 20 are aligned longitudinally. On the other hand, the windows 211, 212 of the lower tongue 21 are offset longitudinally over a distance substantially equal to the pitch P. Thus, in a first configuration of the pull element, the windows 201 and 211 are facing one another, exposing a graduation of the line of odd numbers of the plate 1 (cf. FIGS. 6 and 9). The window 202 is on the other hand facing a solid surface of the lower tongue 21, in such a way that no graduation of the line of even numbers is exposed. Inversely, in a second configuration of the pull element, the windows 202 and 212 are facing one another, exposing a graduation of the line of even numbers of the plate 1 (cf. FIGS. 7 and 8). The window 201 is on the other hand facing a solid surface of the lower tongue 21, in such a way that no graduation of the line of odd numbers is exposed.

In theory, an odd number of one line of graduations is aligned with the next immediately higher even number of the other line of graduations; however, according to the clearances that may exist between the two tongues along the direction of opening or of closing, it may be preferable to offset said numbers slightly.

Advantageously, each tongue 20, 21 cooperates with the plate 1 by a longitudinal rib (designated by the mark 204 in FIG. 4) engaged in a corresponding groove 13 of the plate.

Moreover, the device advantageously comprises an indexing mechanism of the pull element with respect to the plate. This mechanism comprises a notched slider 203, 213 formed on each one of the tongues, the distance between two adjacent notches being equal to the pitch P. The notched slider is arranged on the longitudinal edge of each tongue opposite the rib that slides in the groove 13. The indexing mechanism furthermore has two teeth 11, 12 arranged on the plate 1 and extending transversally to the direction of sliding. Each tooth cooperates with the notches of a corresponding slider, the pull element being in a stable position with respect to the plate when each tooth is engaged in a corresponding notch. Each tooth 11, 12 advantageously has a certain flexibility in the transversal direction so as to be able to retract sufficiently to allow for the sliding of the pull element from one configuration to another.

The tongues 20, 21 advantageously have a retaining means 205, 215 protruding outwards and suitable for abutting against the corresponding tooth 11, 12 if a user attempts to slide the pull element in the direction of closing beyond the completely closed configuration, which makes it possible to prevent the tongues from being extracted from the device.

The device may further comprise a cover 3 that makes it possible to maintain the pull element 2 on the plate. The cover 3 advantageously comprises a longitudinal opening 30 that allows a user to access the actuating lug 22 of the pull element. The length of opening 30 is adapted to the total travel of the lug 22 between an entirely closed configuration and an open configuration.

The device may be manufactured by injection with plastic material of the plate, of each pull element and of the cover, then assembly of the pull element on the plate and closing of the cover. This method of manufacturing therefore entails a limited number of parts and simple moulding and assembly techniques.

FIGS. 2 and 6 to 9 show different configurations of the device for dosing or counting objects (the cover not being shown in order to make it possible to view the indexing mechanism of the pull element).

FIG. 2 shows the device in the completely closed configuration. In this configuration, each one of the tongues 20, 21 covers all of the recesses of the corresponding pair of rows R1-R2; R3-R4, in such a way that no object can be received in a recess.

Figure 6:
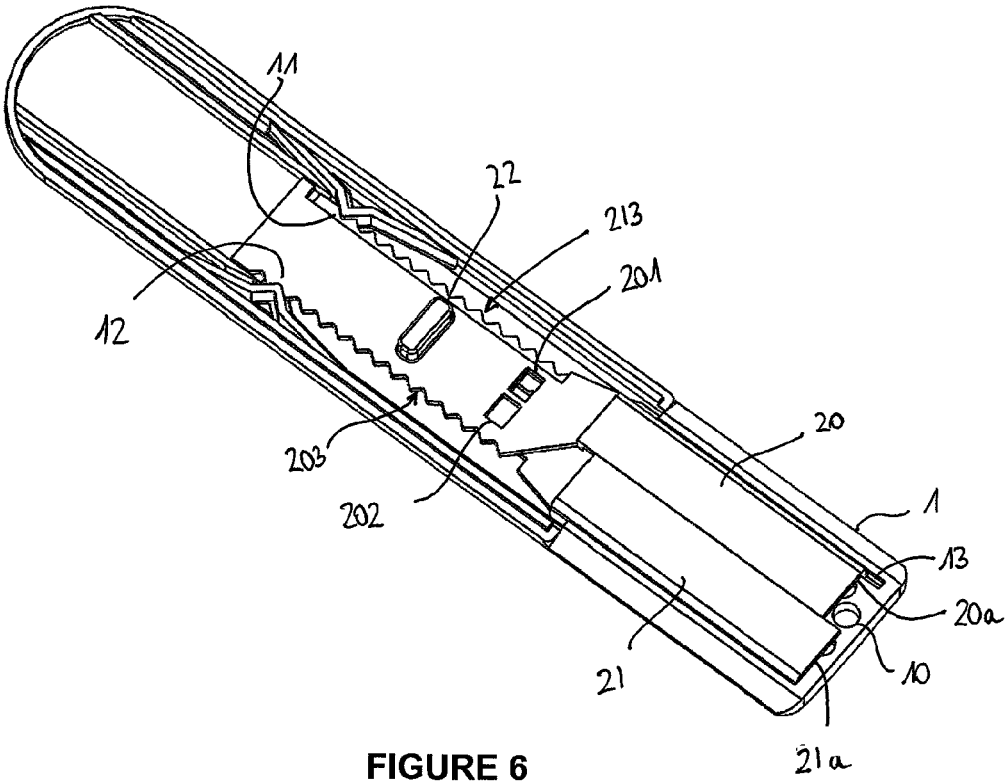
FIG. 6 is a perspective view of said device, in a configuration of use that makes it possible to dose a single object.

FIG. 6 shows the device with the pull element in a position that makes it possible to uncover a single recess 10. In this position, the end 20*a* of the tongue 20 is offset over a distance equal to the pitch P with respect to the end 21*a* of the tongue 21 in the direction of opening of the device. Thus, only one recess of the row R2 is uncovered; the adjacent recess of the row R1 is covered by the tongue 20 and the recesses of rows R3 and R4 are completely covered by the tongue 21. To pass from the configuration of FIG. 2 to that of FIG. 6, the user must move the lug 22 over a distance equal to the pitch P in the direction of opening, which induces an offset of one of the notches of the teeth 11, 12 with respect to the sliders 203, 213. Moreover, the window 201 of the tongue 20 is facing the window 211 of the tongue 21, thus allowing to appear the digit 1 corresponding to the only recess uncovered, while the window 202 of the tongue 20 is facing a solid surface of the tongue 21, in such a way that no even number can be seen.

Figure 7:
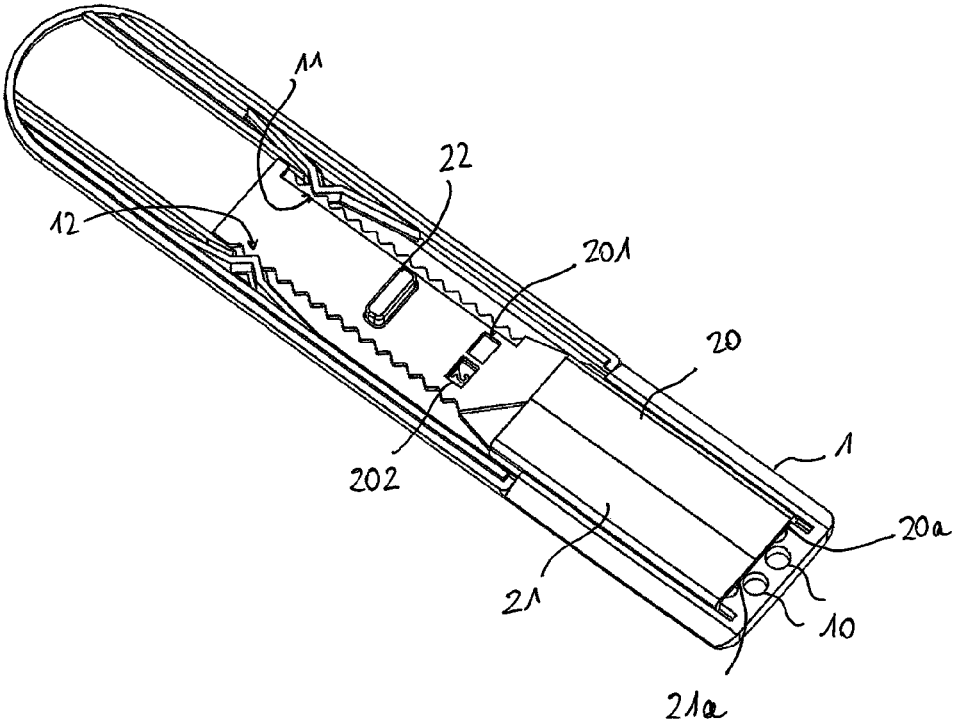
FIG. 7 is a perspective view of said device, in a configuration of use that makes it possible to dose two objects.

FIG. 7 shows the device with the pull element in a position that makes it possible to uncover two recesses 10. In this position, the end 20*a* of the tongue 20 is aligned longitudinally with the end 21*a* of the tongue 21. Thus, a recess of row R2 and a recess of row R3 are uncovered; the adjacent recess of row R1, respectively R4 remains covered by the tongue 20, respectively 21. To pass from the configuration of FIG. 6 to that of FIG. 7, the user must move the lug 22 over a distance equal to the pitch P in the direction of opening, which, thanks to the drive mechanism, causes a simultaneous sliding of the two tongues along said distance (the remaining tongues therefore offset with respect to one another, thus uncovering three recesses: the first recess of the rows R1 and R2 and the first recess of the row R3); then, the user must move the lug 22 in the direction of closing over a distance equal to the pitch P, which, thanks to the actuating mechanism, induces a sliding only of the tongue 20. Thus, the ends 20*a* and 21*a* of the two tongues are aligned longitudinally and uncover only the first recess of the row R2 and the first recess of the row R3. The teeth 11, 12 remain in the same position with respect to the sliders 203, 213 as in FIG. 6. Moreover, the window 202 of the tongue 20 is facing the window 212 of the tongue 21, thus allowing to appear the digit 2 corresponding to the two recesses uncovered, while the window 201 of the tongue 20 is facing a solid surface of the tongue 21, in such a way that no odd number can be seen.

It is possible, according to the same principle, uncover any number desired, odd or even, of recesses according to the number of objects to be dosed or counted, by actuating the lug 22 in a direction of opening and/or of closing.

Generally, an odd number of recesses is obtained with the ends 20*a*, 21*a* of the tongues offset longitudinally over a distance of the pitch P. From a completely closed configuration of the device, such a configuration is obtained by moving the lug in the direction of opening until the desired number appears in the windows 201, 211. Thanks to the drive mechanism, the movement of the lug is equal to the distance of the pitch P, only the tongue 20 is moved, the tongue 21 remains immobile; then when the lug is moved over a distance greater than the pitch P, the two tongues slide simultaneously in the direction of opening.

An odd number of recesses is obtained with the ends 20*a*, 21*a* of the tongues aligned longitudinally. From a completely closed configuration of the device, such a configuration is obtained by moving the lug in two opposite directions: a first movement in the direction of opening until an odd number greater than the number desired appears in the windows 201, 211, then a second movement in the direction of closing until the desired even number appears in the windows 202, 212. Thanks to the drive mechanism, the passing from the position that uncovers an odd number of objects to the position that uncovers the desired even number of objects, the movement of the lug in the direction of closing over a distance equal to the pitch P causes a sliding of the tongue 20 only, the tongue 21 remaining immobile; then, when the lug is moved over a distance greater than the pitch P (if the difference between the odd number and the even number is greater than one), the two tongues slide simultaneously in the direction of closing.

FIGS. 10 to 18 diagrammatically show an embodiment that comprises three tongues, each one being able to uncover or cover three rows of recesses.

Since the structure of the different parts is similar to that of the embodiment shown in FIGS. 1 to 9, this structure shall not be described again in detail here. The particularities linked to the implementation of the device will however be described hereinafter.

Figure 10:
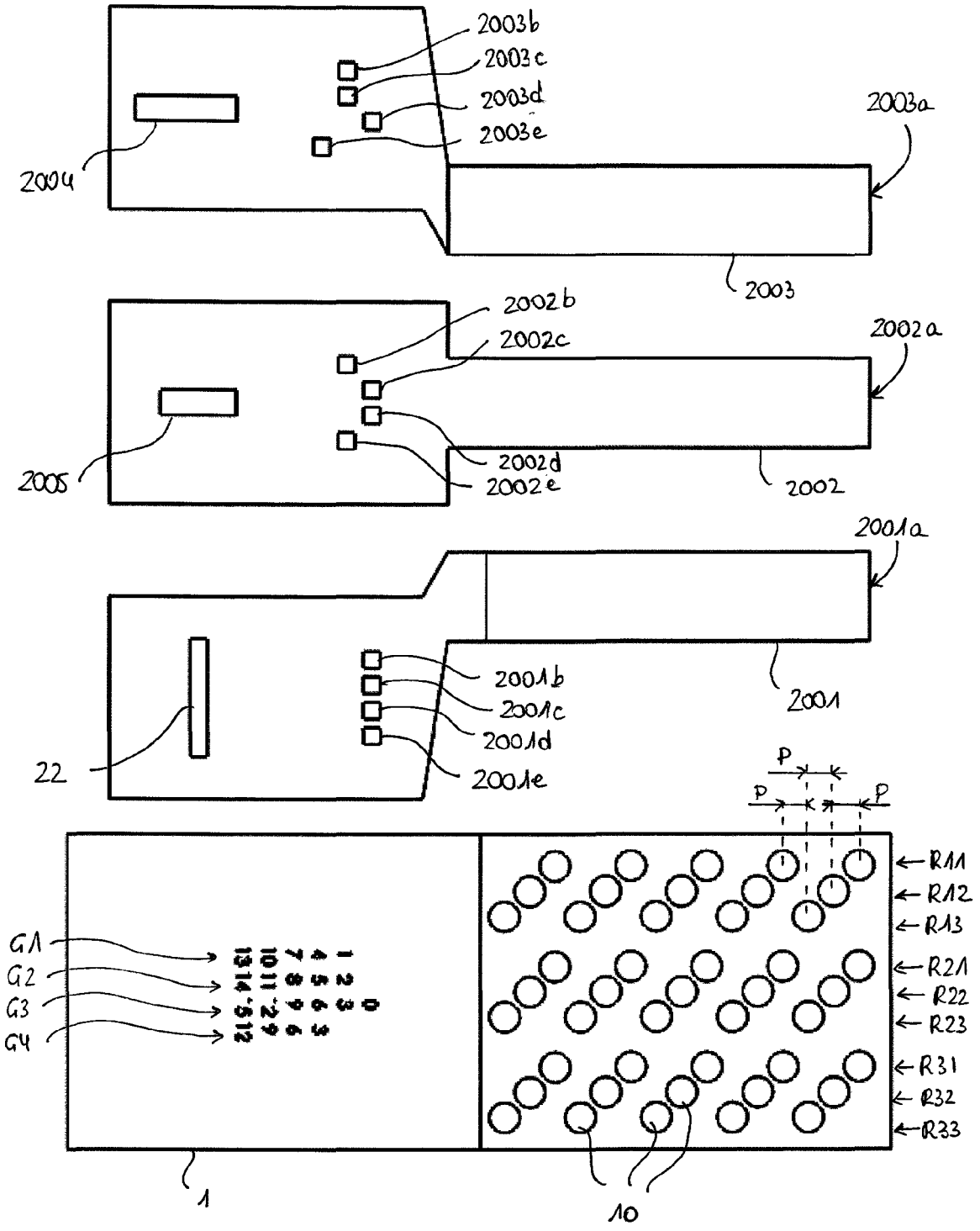
FIG. 10 is an exploded top view of another embodiment of the device.
Figure 11:
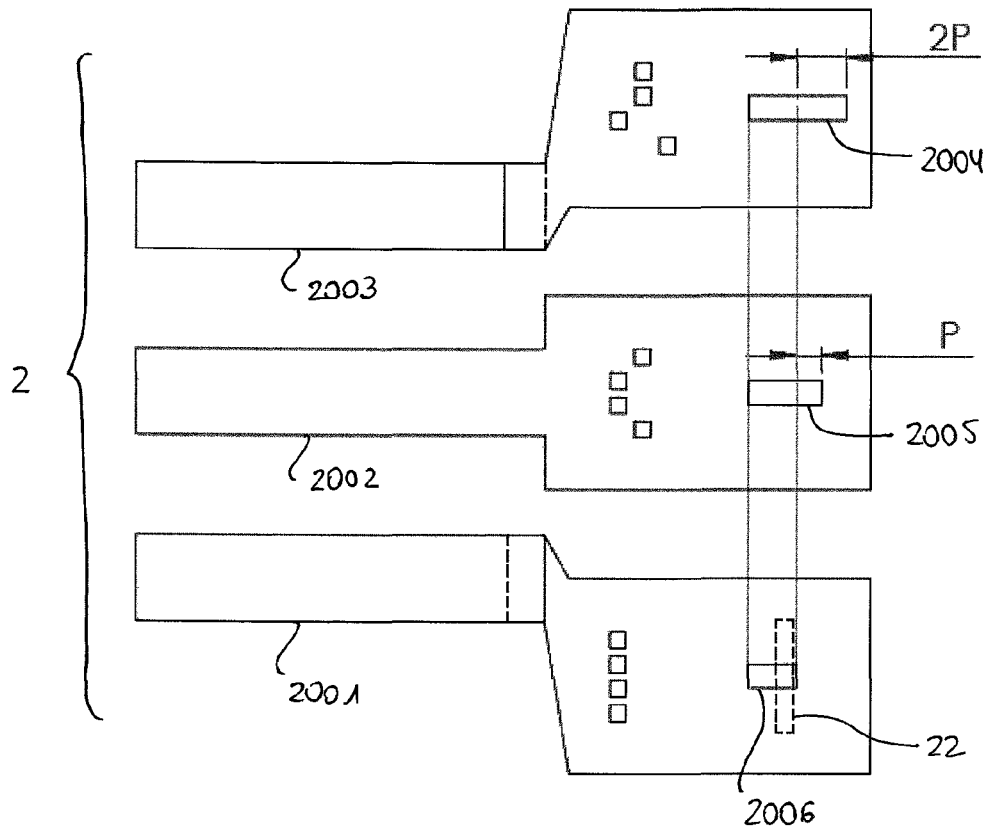
FIG. 11 is an exploded bottom view of the tongues that form the pull element of the device of FIG. 10.

FIG. 10 diagrammatically shows the plate 1 comprising the recesses 10 and the three tongues 2001, 2002, 2003 that together form the pull element 2. The cover has been omitted but it may naturally be present.

The recesses are organised in series of three parallel rows, respectively R11-R13 (corresponding to the tongue 2001), R21-R23 (corresponding to the tongue 2002) and R31-R33 (corresponding to the tongue 2003). Within each series, a recess of a row is offset longitudinally by a pitch P with respect to an immediately adjacent recess on an adjacent row. In other terms, for example, a recess of the row R13 is offset over a distance equal to the pitch P of the recess that is the closest to the row R12, which itself is offset over a distance equal to the pitch P of the recess that is the closest to the row R11. Consequently, said recess of the row R13 is offset longitudinally by double of the pitch P with regards to said recess of the row R11.

Moreover, the recesses of a determined row of a series (for example the row R11) are aligned longitudinally with the recesses of the corresponding row in the other series (i.e., to continue the example, the rows R21 and R31).

The pull element is formed by successive superposition of the tongues 2001, 2002, 2003 (the tongue 2003 being the closest to the bottom of the plate 1). The tongue 2001 comprises moreover an actuating lug 22.

The tongues 2001, 2002 and 2003 are coupled by a drive mechanism that comprises, on the tongue 2001, an abutment 2006; on the tongue 2002, a notch suitable for receiving the abutment 2006, the length of the notch 2006 being greater by a length equal to the pitch P than the length of the abutment 2006; on the tongue 2003, a notch 2004 suitable for receiving the abutment 2006, the length of the notch 2004 being greater by a length equal to the pitch P than the length of the notch 2005, and by a length greater by a length equal to double the pitch P than the length of the abutment 2006. Thus, from an initial relative position of the tongues 2001, 2002, 2003, a movement of the actuating lug 22 in a direction of opening or of closing drives the sliding of the tongue 2001 and, if the abutment 2006 is in contact with the edge of the notch 2005 and/or the edge of the notch 2004 in the direction of actuation, a sliding of the tongue 2002 and/or of the tongue 2003.

Moreover, with respect to the embodiment with two tongues, where the graduations indicating the number of uncovered recesses were distributed over two lines, the graduations are, in the embodiment with three tongues, distributed over four lines G1-G4, being noted that certain numbers are present twice in these graduations (in particular 3, 6, 9).

Each tongue consequently has four openings (designated by the reference sign of the tongue followed by the letters b, c, d or e) facing each one of the lines of graduation. Note that, according to the tongue considered, the openings may be aligned or offset over a distance equal to P or double P. The arrangement of these openings is defined in line with the position of the numbers on the lines of graduation and the different possible configurations of the pull element. Those skilled in the art are able to determine this arrangement according to the total number of objects to be dosed or counted by the device.

Advantageously, although not shown, the device also comprises an indexing mechanism similar to the one described hereinabove, namely a notched slider arranged on at least the tongue 2001, and preferably on the three tongues, cooperating with two opposite teeth of the plate.

FIGS. 12 to 18 show different configurations of the device.

Figure 12:
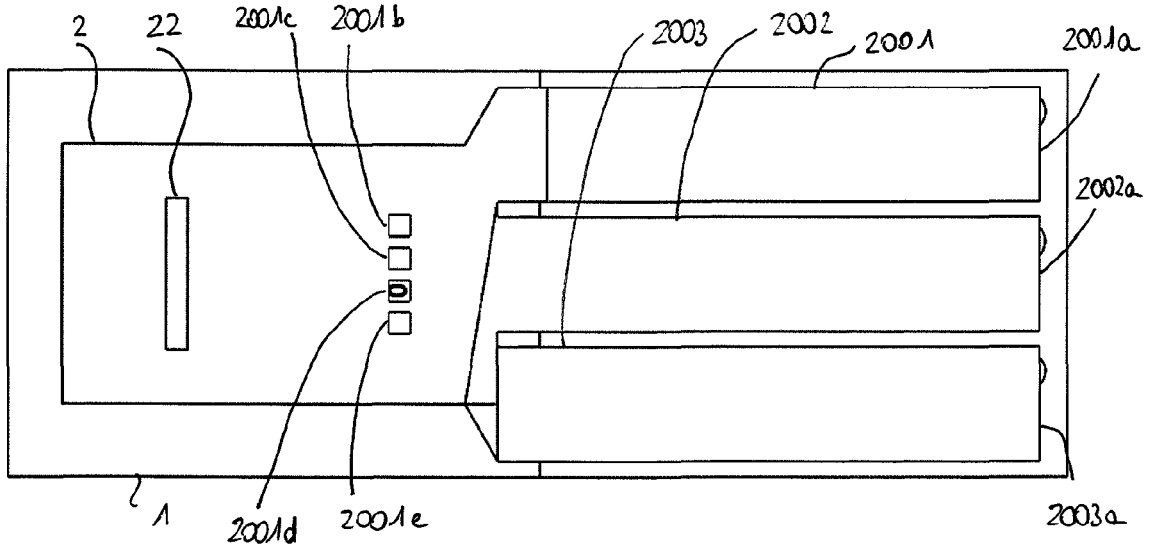
FIGS. 12 to 18 show different configurations of use of the device of FIG. 10.

In FIG. 12, the device is in the closed configuration, the three tongues 2001-2003 covering all the recesses of the plate 1. The ends 2001*a*, 2002*a*, 2003*a* of the three tongues are aligned longitudinally.

Figure 13:
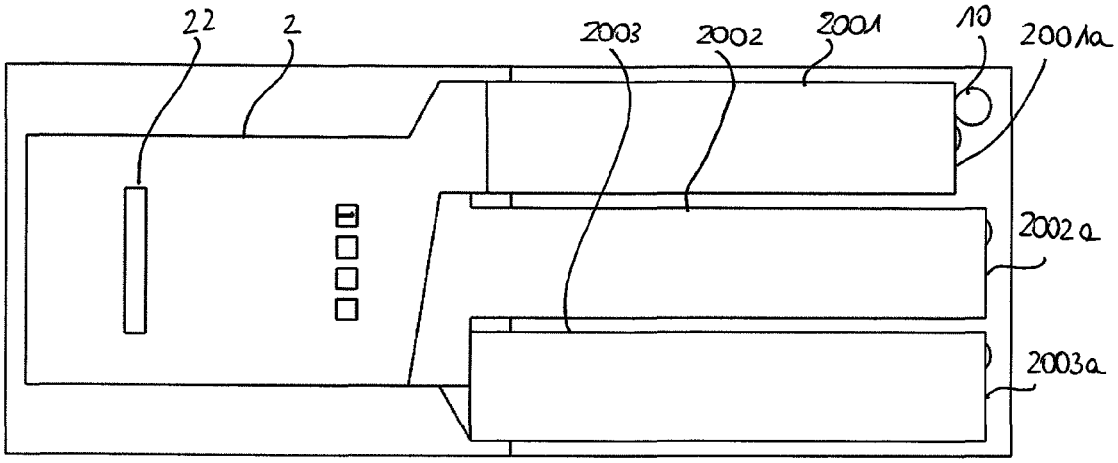

In FIG. 13, the tongue 2001 is offset in the direction of opening by a pitch P, thus uncovering a recess 10 of the row R11. The tongues 2002 and 2003 remain in the position of FIG. 12.

Figure 14:
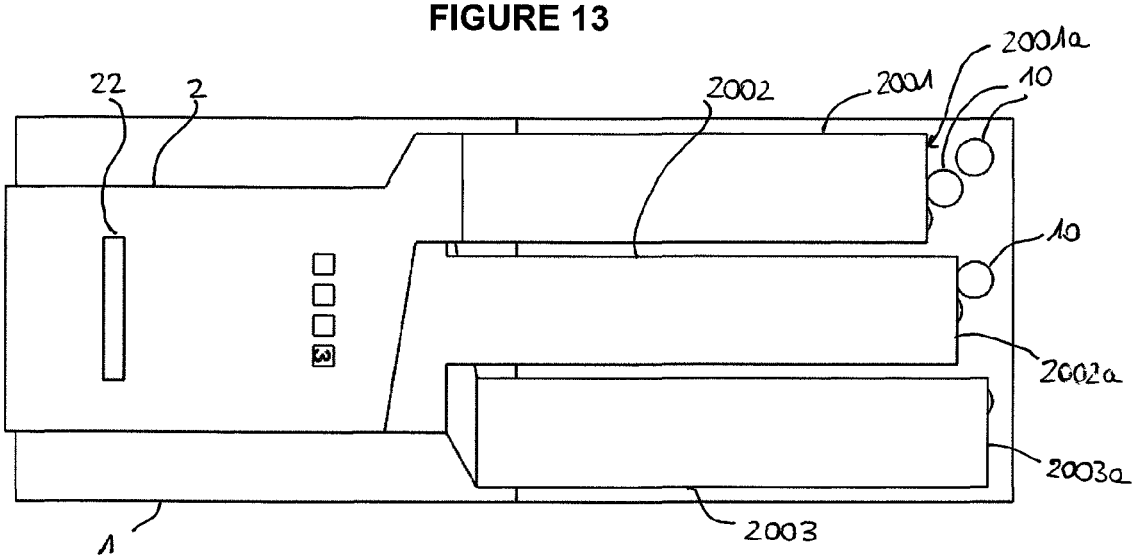

In FIG. 14, the tongue 2001 is offset in the direction of opening by a pitch P with respect to its position of FIG. 13 (or double the pitch P with respect to its position of FIG. 12), and the tongue 2002 is also offset by a pitch P in the direction of opening, thanks to the drive mechanism. The tongue 2003 remains in its position of FIGS. 12 and 13. Thus, three recesses 10 are uncovered (one on the row R11, one on the row R12, and one on the row R21).

Figure 18:
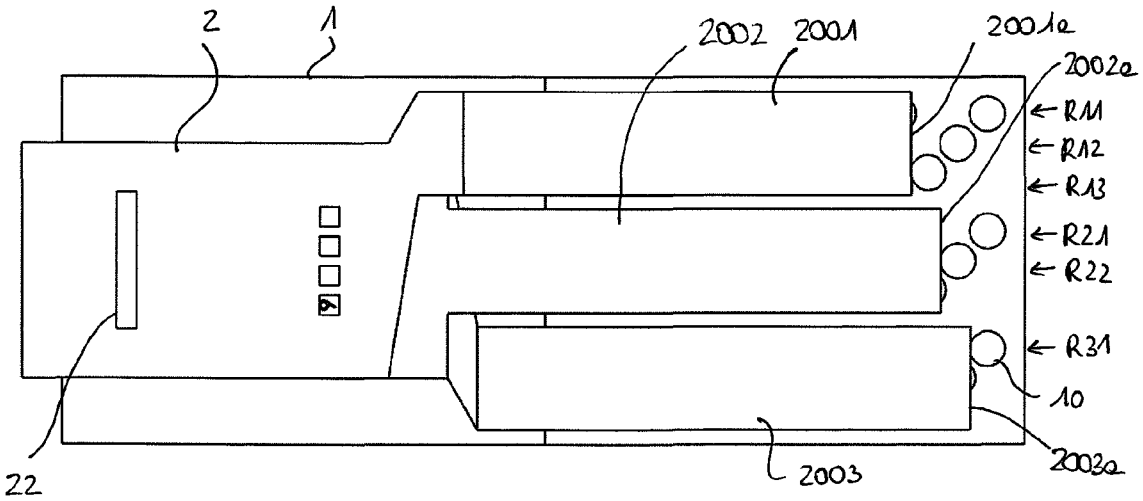

Another movement by a pitch P of the tongue 2001 in the direction of opening has for effect to drive the tongues 2002 and 2003 in sliding, leading to the configuration of FIG. 18, where six recesses are uncovered.

Figure 17:
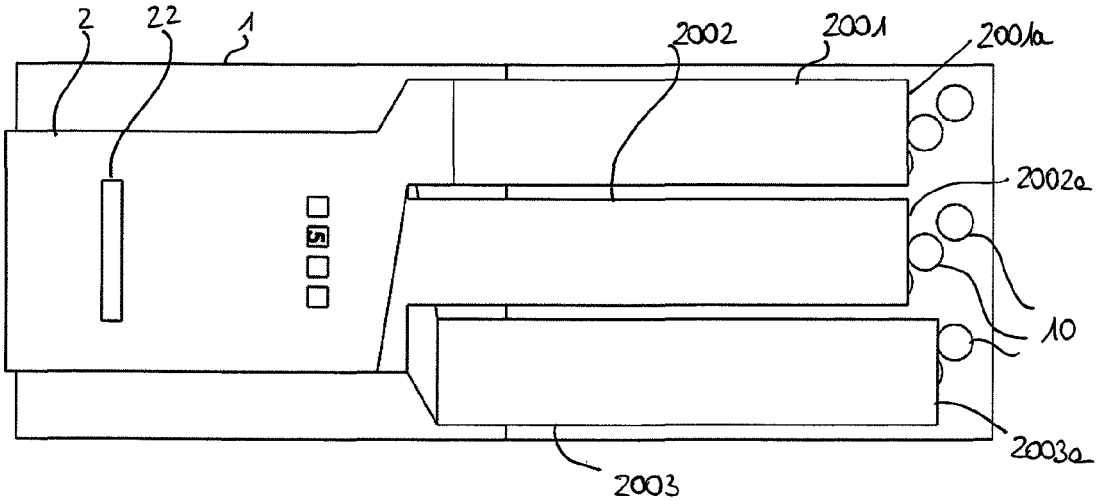

If the user wishes to uncover only five recesses, the user moves the tongue 2001 in the direction of closing by a pitch P, the two other tongues 2002 and 2003 not being driven, which leads to the configuration of FIG. 17.

Figure 15:
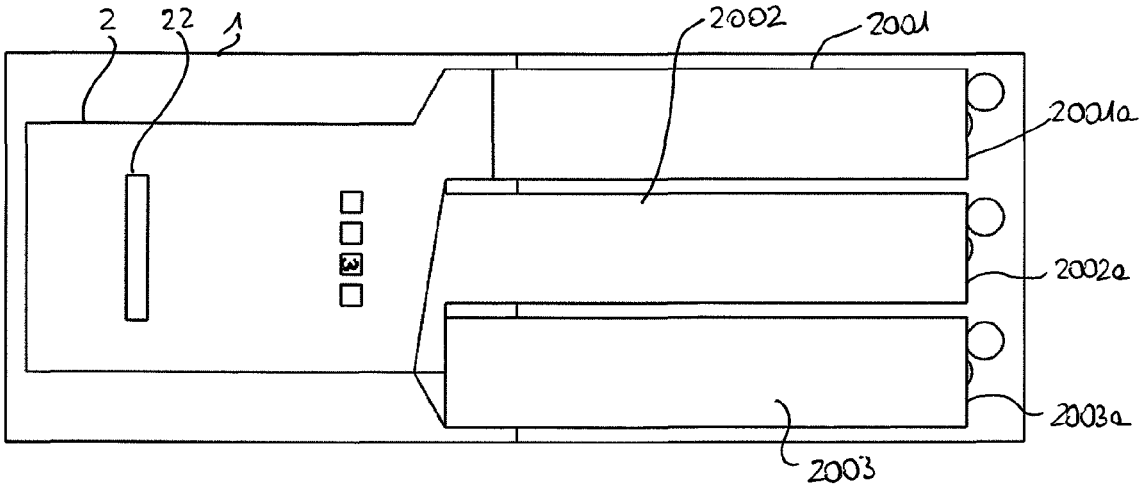
Figure 16:
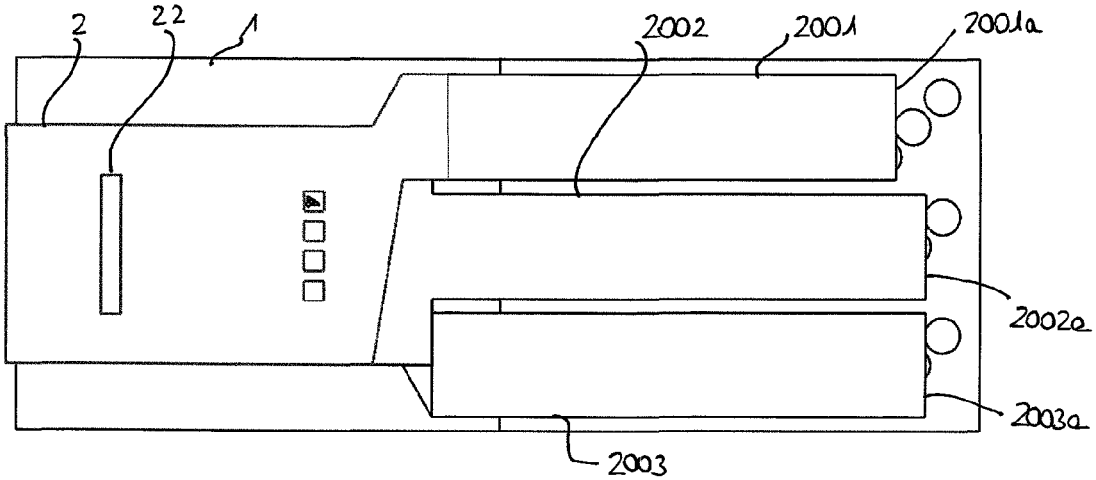

If the user wishes to uncover only four recesses, from the configuration of FIG. 17, the user again moves the tongue 2001 by a pitch P in the direction of closing, the tongue 2001 then driving the tongue 2002, thus resulting in the configuration of FIG. 15, where three recesses are uncovered, then the user moves the tongue 2001 in the opposite direction (in the direction of opening) by a pitch P, the tongues 2002 and 2003 remaining immobile, thus resulting in the configuration of FIG. 16.

The device that has just been described may be used in particular for dosing or counting drugs that are in the form of granules, micro-granules, tablets, etc. The device is particularly advantageous for objects of a small size (for example of about 0.5 mm to 5 mm), because it makes it possible, by immersing the plate into a recipient containing said objects, to take simply the exact desired number of objects, without the user having to manipulate the objects.

Moreover, in order to facilitate the emptying of recipients, the plate may have a domed concave end (not shown) forming a spoon, adjacent to the zone that comprises the recesses. This spoon makes it possible to more easily recover the last objects contained in a container.

Figure 19:
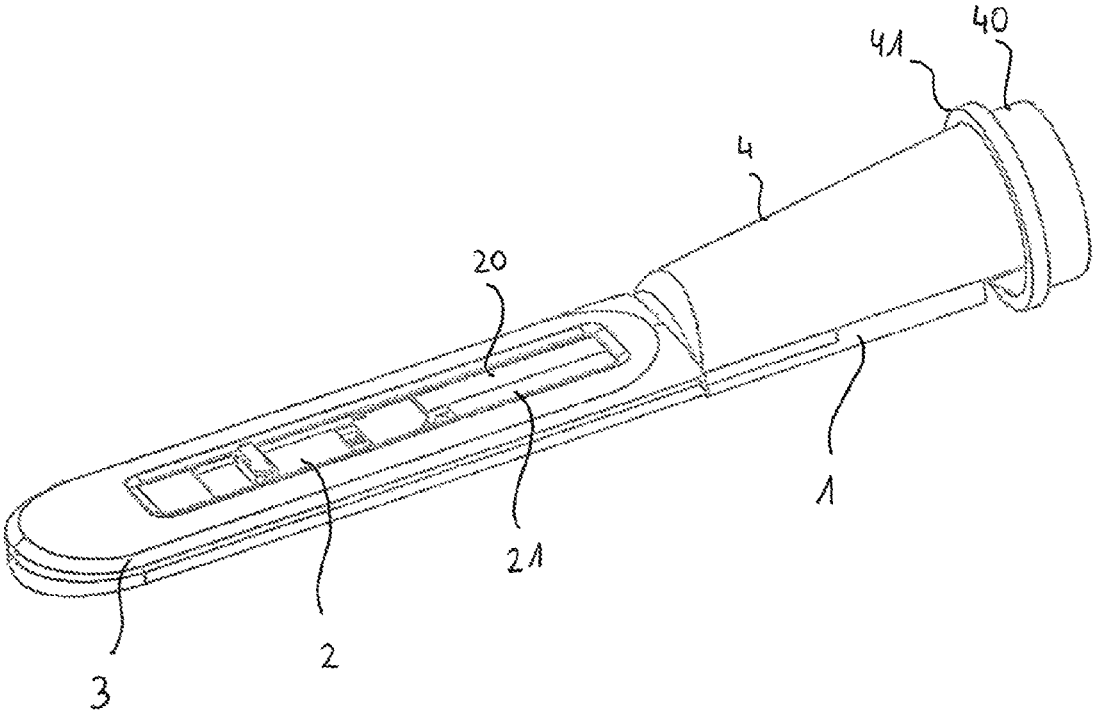
FIG. 19 is a perspective view of a device further comprising a cap.
Figure 20:
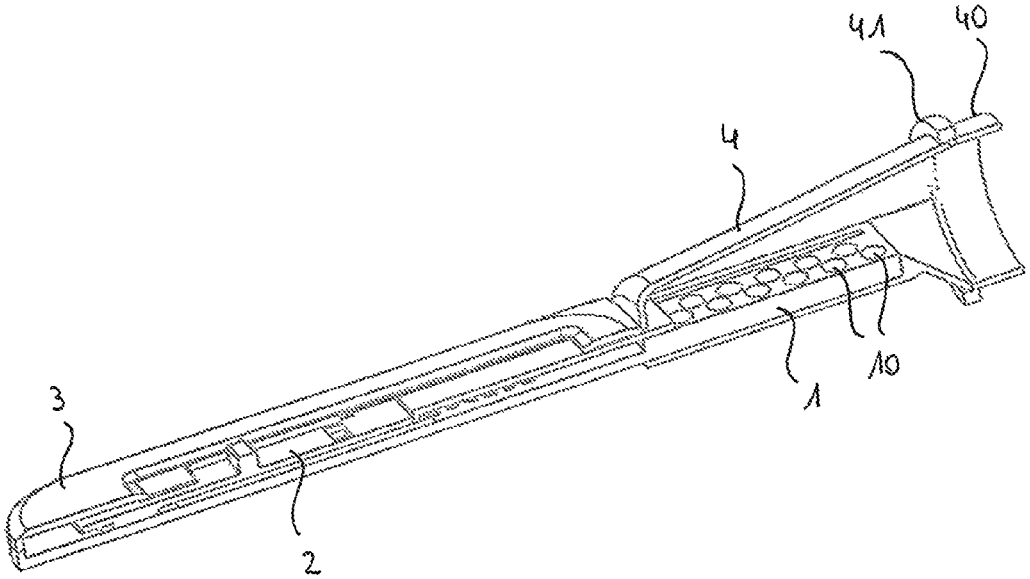
FIG. 20 is a partial cross-section view of the device of FIG. 19.

According to a particularly advantageous embodiment shown in FIGS. 19 and 20, the device further comprises a cap 4 extending around the plate 1 and comprising an endpiece 40 suitable for being attached to a recipient containing the objects to be counted or dosed. For example, the endpiece 40 has a tubular shape that can be inserted into the neck of a recipient. The endpiece is advantageously provided with a collar 41 that extends radially and forming an abutment during the engagement of the endpiece in the neck of the recipient.

Figure 21:
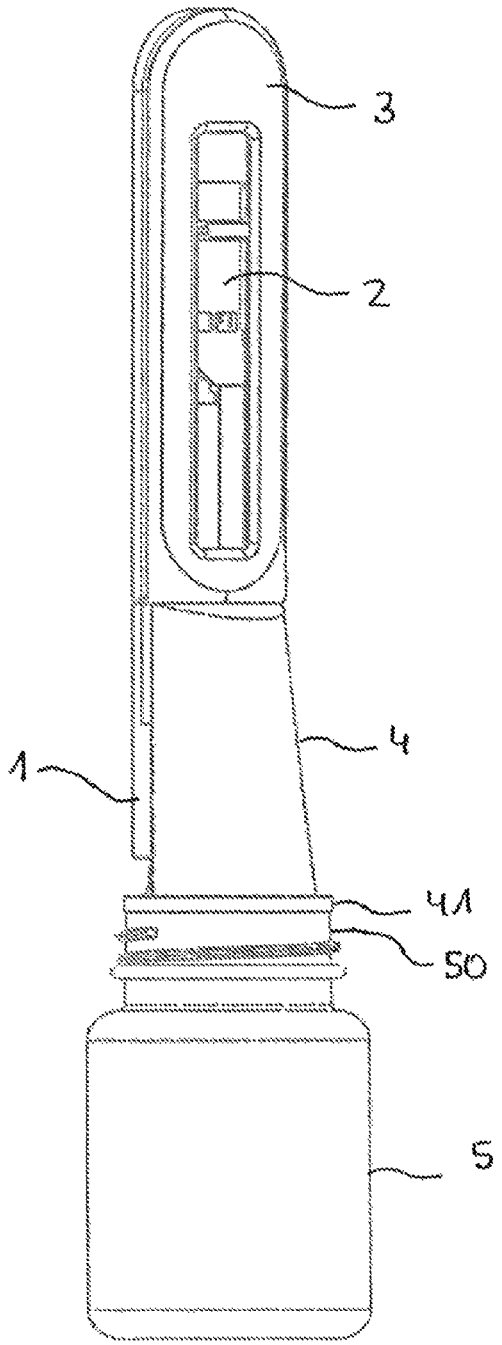
FIG. 21 shows the device of FIGS. 19 and 20 connected to a recipient containing the objects to be dosed.

FIG. 21 shows the device of FIGS. 19 and 20 after connection to a recipient 5 containing the objects to be counted or dosed. The recipient 5 comprises a neck 50 inside of which the endpiece 40 of the cap is mounted, preferably with a slight clamping in order to allow for sufficient mechanical resistance of the device on the recipient in light of later manipulations that are described hereinbelow. The collar 41 of the cap is bearing against the edge of the neck 50. Of course, this method of connection is provided solely for the purposes of illustration and those skilled in the art may use any other means to connect the cap to a recipient. For example, the endpiece of the cap could be mounted outside the neck of the recipient instead of inside; moreover, instead of an attaching via friction, the endpiece could be screwed on or in the neck of the recipient.

The cap 4 thus makes it possible to form, with the plate 1, a volume for receiving objects taken from the recipient. Thanks to this cap, the taking of objects from the recipient is facilitated, in particular when there are only a few objects to be taken at the bottom of the recipient. In indeed, once the endpiece 40 of the has been connected to the recipient (cf. FIG. 21), it is sufficient to tilt the recipient 5 to transfer the objects in the cap 4, bring the plate 1 to a substantially horizontal position in order to allow each uncovered recess 10 to receive an object, then, by slightly tilting the plate 1, transfer the excess objects in the recipient. The user can then extract the retained objects from their recesses by tilting the plate 1 further, and by removing the objects through the endpiece 40.

The mechanical connection between the cap 4 and the plate 1 is designed to prevent any dead zone in which an object could remain stuck.

Preferably, the cap has at least one transparent portion facing the plate 1, thus making it possible for the user to check if all the uncovered recesses 10 have indeed been filled by an object. The cap may be made entirely from a transparent material or include only a transparent window.

Naturally, the invention could have application in other fields that require dosing or counting a precise number of objects.

REFERENCES

US 2004/0191313

The invention claimed is:

1. A device for dosing or counting objects, comprising:

a plate provided with a plurality of recesses each suitable for receiving a single object, said recesses being arranged in at least two series of at least two rows disposed in parallel along a longitudinal axis such that the recesses in a first row one series, are offset longitudinally relative to the recesses in the second row by a non-zero pitch;

a pull element arranged to slide relative to the plate along said longitudinal axis, said pull element comprising at least two adjacent tongues, each designed to cover or uncover a corresponding series of rows, said tongues being arranged to slide relative to one another over a distance equal to said pitch and coupled by a drive mechanism configured such that the sliding of the pull element along the longitudinal axis over a distance greater than said pitch causes the simultaneous movement of the two tongues.

2. The device of claim 1, wherein the drive mechanism comprises a longitudinal notch formed in at least one of the tongues and an abutment extending in the notch from another tongue, the difference between the length of the notch and the length of the abutment being substantially equal to said pitch.

3. The device of claim 1, wherein the recesses are arranged in the form of two pairs of two parallel rows and the pull element comprises two tongues.

4. The device of claim 3, wherein the drive mechanism is configured to provide the following positions of the pull element with respect to the plate:

a closed position in which each one of the tongues covers all of the recesses of the corresponding pair of rows;

a plurality of first open positions in which the tongues uncover an odd total number of recesses, the ends of said tongues being offset longitudinally over a distance equal to the pitch; and a plurality of second open positions in which the tongues uncover an even total number of recesses, the ends of said tongues being longitudinally aligned;

the passing from the closed position to a first open position comprising a longitudinal movement of a first tongue in a direction of opening over a distance equal to the pitch, the other tongue remaining immobile, then, if the number objects is greater than one, a simultaneous longitudinal movement of the two tongues in the direction of opening;

the passing from a first open position to a second open position comprising a longitudinal movement of the first tongue over a distance equal to said pitch in a direction of closing then, if the difference between the number of objects is greater than one, a simultaneous longitudinal movement of the two tongues in the direction of closing.

5. The device of claim 3, wherein the plate includes two lines of graduations, each graduation indicating a unique number of objects, and the pull element comprises two windows arranged facing a corresponding line of graduations in such a way that the total number of recesses uncovered by the pull element appears through one of the two windows.

6. The device of claim 5, wherein the graduations of one of said lines indicate the even numbers of objects and the graduations of the other line indicate the odd numbers of objects.

7. The device of claim 6, wherein each tongue comprises a corresponding first window arranged facing the line of graduations indicating the odd numbers of objects, and a corresponding second window arranged facing the line of graduations indicating the even numbers of objects, the first and the second window of one tongue being longitudinally aligned while the first and the second window of the other tongue are offset longitudinally over a distance equal to said pitch.

8. The device of claim 6, wherein an odd number of one line is substantially aligned longitudinally with the next immediately higher even number of the other line.

9. The device of claim 1, wherein the recesses are arranged in the form of three series of three parallel rows and the pull element comprises three tongues.

10. The device of claim 1, wherein each tongue cooperates with the plate by a notched slider, the distance between two adjacent notches being equal to said pitch.

11. The device of claim 10, wherein the plate has a tooth extending transversally and being engaged in a notch of a corresponding slider.

12. The device of claim 1, further comprising a cover rigidly connected to the plate, the pull element being arranged between the plate and the cover.

13. The device of claim 1, wherein the plate comprises between ten and thirty recesses.

14. The device of claim 1, wherein each recess has a circular contour.

15. The device of claim 1, wherein the pitch is less than the size of said recesses.

16. The device of claim 1, wherein the plate has a domed concave end forming a spoon.

17. The device of claim 1, further comprising a cap extending around the plate to form with the plate a volume for receiving objects, said cap comprising an endpiece suitable for being attached to a recipient containing the objects to be counted or dosed.

18. The device of claim 17, wherein the cap comprises a transparent portion facing the plate configured to allow a user to check if an object is present in each recess uncovered.

* * * * *